US009537227B1

(12) United States Patent
Morello et al.

(10) Patent No.: US 9,537,227 B1
(45) Date of Patent: Jan. 3, 2017

(54) FEMALE ELECTRICAL TERMINAL AND METHOD OF MANUFACTURING THE SAME

(71) Applicant: DELPHI TECHNOLOGIES, INC., Troy, MI (US)

(72) Inventors: John R. Morello, Warren, OH (US); James M. Rainey, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 14/972,768

(22) Filed: Dec. 17, 2015

(51) Int. Cl.
*H01R 9/24* (2006.01)
*H01R 4/48* (2006.01)
*H01R 43/16* (2006.01)

(52) U.S. Cl.
CPC ..... *H01R 4/4809* (2013.01); *H01R 43/16* (2013.01)

(58) Field of Classification Search
CPC ..... H01R 4/28; H01R 4/48; H01R 4/4809; H01R 43/16
USPC ..... 439/816–817, 884–887
See application file for complete search history.

(56) References Cited

U.S. PATENT DOCUMENTS 5,624,289 A 4/1997 Kourimsky
6,056,604 A 5/2000 Roy et al.
6,428,366 B1 * 8/2002 Purushothaman ... H01R 13/114 439/843
7,217,161 B1 * 5/2007 Tyler ..... H01R 4/185 439/748
8,998,657 B1 * 4/2015 Von Eckroth ..... H01R 13/114 439/810

FOREIGN PATENT DOCUMENTS

EP 1089387 A2 4/2001

* cited by examiner

*Primary Examiner* — Khiem Nguyen
(74) *Attorney, Agent, or Firm* — Robert J. Myers

(57) ABSTRACT

A female electrical terminal includes a generally planar base member formed of a first conductive material. The base member includes a connection portion configured to electrically and mechanically contact with a corresponding male electrical terminal. The base member further includes an attachment portion configured to be attached to a wire cable. The female electrical terminal also includes a cover member that is formed of a second conductive material. The cover member longitudinally encircles the connection portion and defines a biasing member depending from the cover member and into a cavity formed by the cover member. The biasing member is configured to bias the male electrical terminal into electrical and frictional contact with the connection portion of the base member of the female electrical terminal. A method of producing such female terminal assemblies wherein the cover members are interconnected by a carrier strip is also provided.

20 Claims, 5 Drawing Sheets

FEMALE ELECTRICAL TERMINAL AND METHOD OF MANUFACTURING THE SAME

TECHNICAL FIELD OF THE INVENTION

The invention relates to a female electrical terminal, particularly a female terminal having a multipart receptacle portion.

BACKGROUND OF THE INVENTION

Electrical terminals may be constructed from copper due to its beneficial electrical conductivity properties. However, in higher current applications, the thickness of the copper required for adequate current carrying capability may increase to the point where the copper material is difficult to bend using typical forming operations and specialized tools may need to be employed in order to form the terminals. After forming, terminals are typicality interconnected by a carrier strip to allow large numbers of terminals to be loaded onto spools that can be fed into machines used to attach the terminals to wire cables. The carrier strip is typically formed concurrently with the terminal and from the same material as the terminal. As the thickness of the terminal material increases, the carrier strip may become to rigid to bend onto a spool and the tools needed to separate the carrier strip from the terminal also increase in cost. Therefore, a terminal capable of high current carrying capability that can be handled by a carrier strip and does not require bending operation to form the current carrying portion of the terminal remains desired.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with an embodiment of the invention, a female electrical terminal is provided. The female electrical terminal includes a generally planar base member formed of a first conductive material. The base member includes a connection portion configured to electrically and mechanically contact with a corresponding male electrical terminal. The base member further includes an attachment portion configured to be attached to a wire cable. The base member extends along a longitudinal axis in an insertion direction corresponding to a direction in which the male electrical terminal is inserted into the female electrical terminal. The female electrical terminal also includes a cover member that is formed of a second conductive material. The cover member longitudinally encircles the connection portion along the longitudinal axis and defines a biasing member depending from the cover member and into a cavity formed by the cover member. The biasing member is configured to bias the male electrical terminal into electrical and frictional contact with the connection portion of the base member of the female electrical terminal.

A major surface of the connection portion may define a contact ridge protruding into the cavity formed by the cover member and may define a plurality of separated contact ridges extending along the longitudinal axis.

The cover member may define a single seam opposite the connection portion and extending along the longitudinal axis. The seam may be joined by a welded connection and/or an interlocking mechanical connection. The cover member may include, a top wall, two side walls, and a bottom wall proximate the connection portion so as to form a rectangular shaped open box.

Opposed minor surfaces of the connection portion may define tabs protruding laterally from the connection portion. The cover member may define elongated apertures configured to receive these tabs.

The first material has a first thickness and a first conductivity. The second material has a second thickness and a second conductivity. The first thickness may be greater than the second thickness. The first conductivity may be greater than the second conductivity. The first material may be a copper based alloy and the second material may be a stainless steel alloy.

In accordance with another embodiment, a method of manufacturing a female electrical terminal is provided. The female electrical connector has a generally planar base member and a cover member. The base member comprises a connection portion configured to electrically and mechanically contact with a corresponding male electrical terminal and the base member further comprises an attachment portion configured to be attached to a wire cable. The base member extends longitudinally in an insertion direction corresponding to a direction in which the male electrical terminal is inserted into the female electrical terminal. The cover member longitudinally encircles the connection portion along the longitudinal axis and defines a biasing member depending from the cover member and into a cavity formed by the cover member. The biasing member is configured to bias the male electrical terminal into electrical and frictional contact with the connection portion. The method includes the steps of providing a bar of a conductive first material, providing a sheet of a second conductive material, cutting the base member from the bar, and forming the generally rectangular cover member that is attached to a perforated carrier strip from the sheet. The method further includes the steps of attaching the cover member to the connection portion of the base member by bending the cover member so that it longitudinally encircles the connection portion along the longitudinal axis, thus forming the female electrical terminal, handling the female electrical terminal by the carrier strip, and removing the carrier strip from the female electrical terminal.

The method includes the optional step of defining a contact ridge that protrudes into the cavity formed by the cover member by embossing a major surface of the connection portion.

The method further includes the optional step of defining a plurality of separated contact ridges extending along the longitudinal axis by embossing the major surface of the connection portion.

The method also includes the optional step of forming a single seam in the cover member opposite the connection portion and extending along the longitudinal axis.

The method additionally includes the optional steps of joining the seam using a welding operation and/or joining the seam using an interlocking mechanical feature.

The cover member may be formed to include a top wall, two side walls, and a bottom wall proximate the connection portion so as to form a rectangular shaped open box.

The method may further include the optional steps of cutting tabs in the base member that protrude laterally from opposed minor surfaces of the connection portion, forming elongated apertures in the cover member, and receiving the tabs within the apertures during the step of attaching the cover member to the connection portion.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Described herein is a female electrical terminal that is configured to receive a corresponding blade shaped male electrical terminal and a method of manufacturing such a terminal. The female electrical terminal, hereinafter referred to as a female terminal, has a base member through which electrical current is conducted from the male electrical terminal, hereinafter referred to as a male terminal, to a wire cable attached to the female terminal. The female terminal also includes a cover member attached to the base member. The cover member encircles a portion of the base member and contains a biasing member, such as a spring, that biases the male terminal into contact with the base member. As the current carrying capability of the female terminal increases, the cross section of the base section is increased proportionally. For packaging reasons, it is typically more beneficial to increase the thickness of the base member than the width of the base member. However, as the thickness of the base member increases, the difficulty of using bending operations to form the base member also increases. The cover member also includes a carrier strip used to handle the female terminal that remains attached to the cover member after the cover member is attached to the base member and remains attached until after a wire cable is secured to the female terminal.

Figure 1:
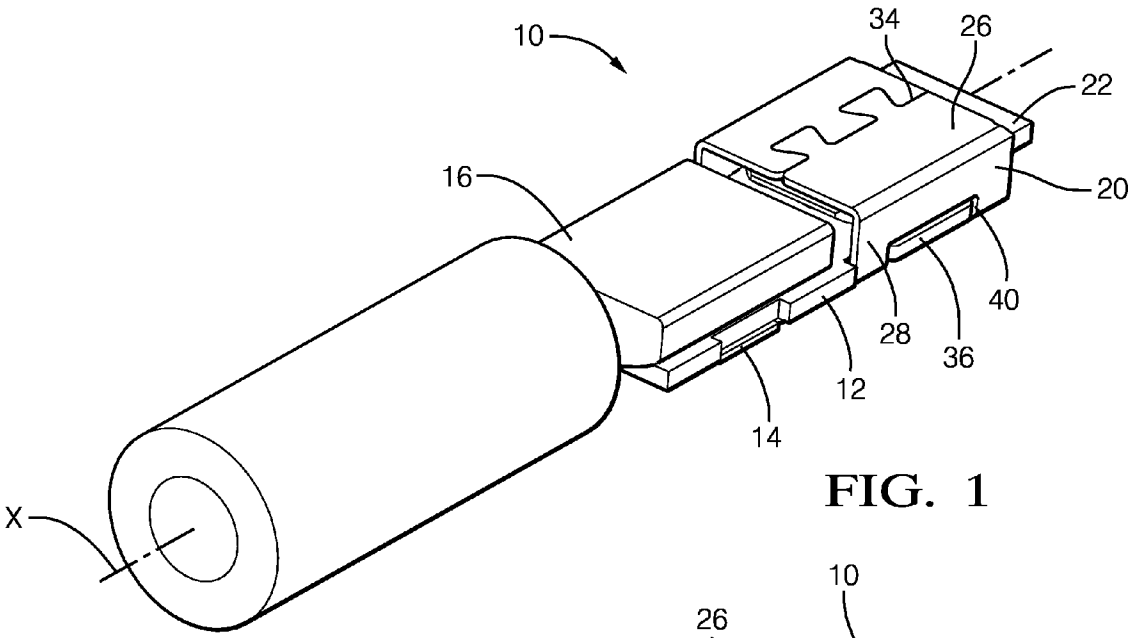
FIG. 1 is a perspective top view of a female terminal assembly according to a first embodiment.
Figure 2:
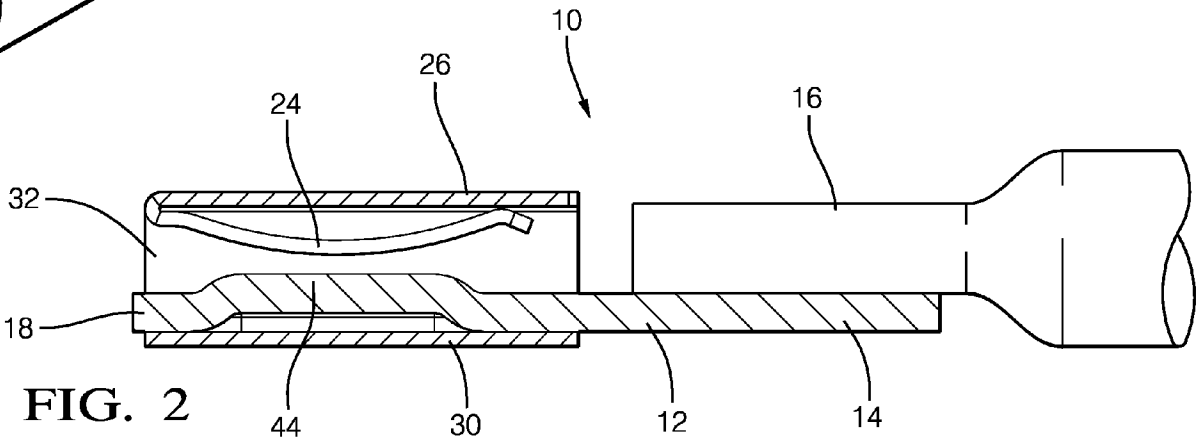
FIG. 2 is a cut away side view of the female terminal assembly of FIG. 1 according to the first embodiment.

FIGS. 1 and 2 illustrate a non-limiting example of a female terminal 10. The female terminal 10 includes a base member 12. An attachment portion 14 of the base member 12 is attached to a wire cable 16. A connection portion 18 of the base member 12 is enclosed by a cover member 20 and the connection portion 18 and cover member 20 cooperate to receive a corresponding male terminal 22.

The generally planar base member 12 has a generally rectangular shape and a generally rectangular cross section and is formed of a first conductive material, such as a copper based alloy. As used herein, a copper based alloy is an alloy in which the major constituent is copper and includes elemental copper. Other embodiments of the base member having different shapes, e.g. trapezoidal and cross sections, e.g. square, may be also be envisioned. The base member 12 includes the planar connection portion 18 that is configured to electrically and mechanically contact the male terminal 22 to the base member 12. The base member 12 further includes the planar attachment portion 14 that is configured to be attached to a wire cable 16. The attachment portion 14 is configured so that the wire cable 16 may be attached to the female terminal 10 via a welding process, e.g. ultrasonic welding or soldering. The attachment portion 14 does not include crimping wings or ferrules (not shown) that are configured to be attached the wire cable 16 via a crimping process. The base member 12 extends along the longitudinal axis X, i.e. along an insertion direction that corresponds to a direction in which the male terminal 22 is inserted into the female terminal 10.

The female terminal 10 also includes the cover member 20 that is formed of a second conductive material, such as stainless steel. The cover member 20 longitudinally encircles the connection portion 18 along the longitudinal axis X and defines a biasing member 24. The cover member 20 includes, a top wall 26, two side walls 28, and a bottom wall 30 proximate the connection portion 18 so as to form a rectangular shaped open box. As shown in FIG. 2, the biasing member 24 is an arcuate tab forming a spring depending from the top wall 26 of cover member 20 and into a cavity 32 formed by the top and side walls 28 of the cover member 20 and connection portion 18 of the base member 12. The biasing member 24 configured to exert a clamping force on the male terminal 22 that biases the male terminal 22 into electrical and frictional contact with the connection portion 18 of the base member 12, thereby improving electrical conduction between the male and female terminals 10, 22.

Figure 3:
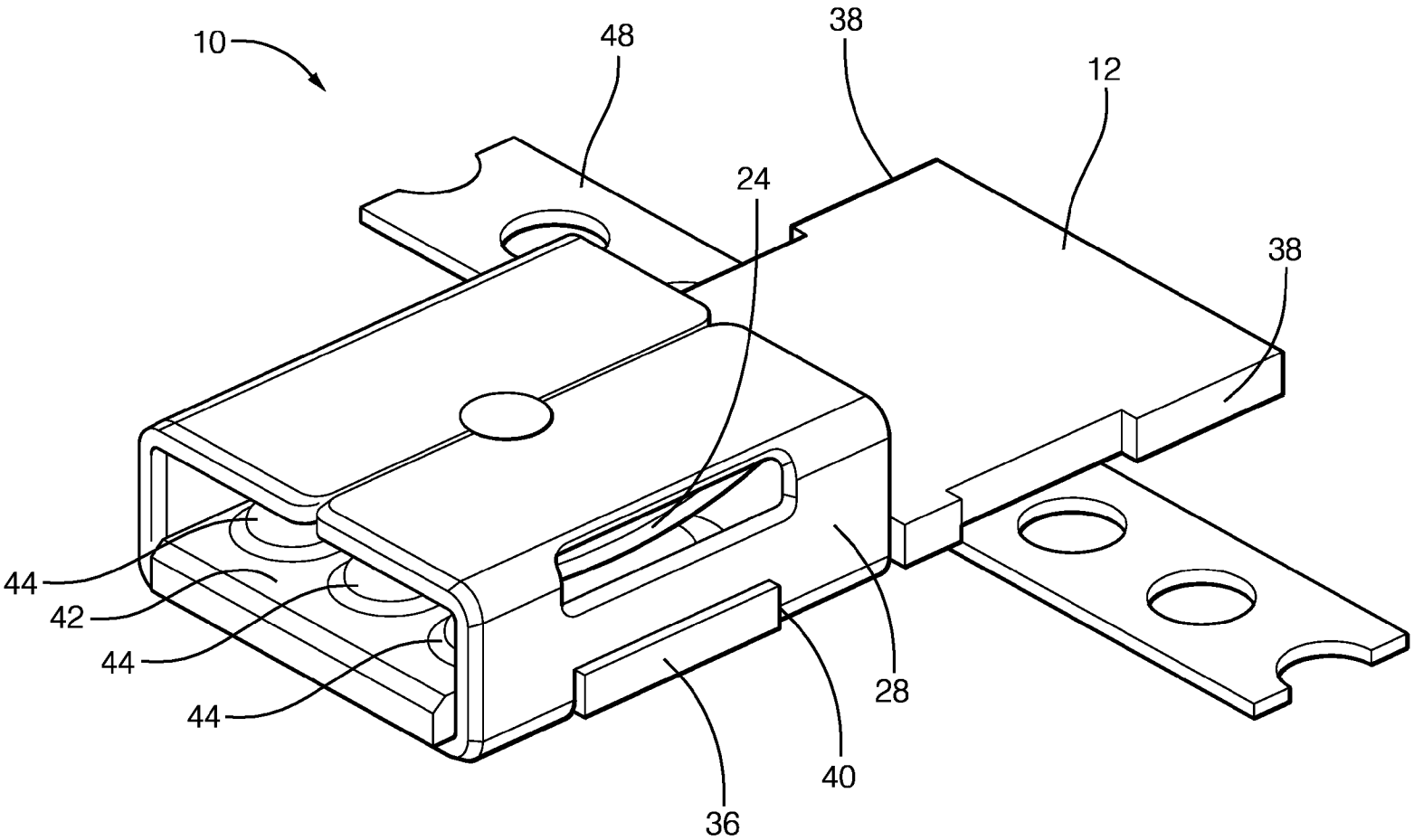
FIG. 3 is a perspective top view of a female terminal assembly according to a second embodiment.

The cover member 20 defines a single seam 34 that extends along the longitudinal axis X. The seam 34 joins two sections of the top wall 26 located opposite the connection portion 18. The seam 34 shown in FIG. 1 is joined by an interlocking mechanical connection, e.g. a dovetail feature defined by each edge of the seam 34. Other embodiments of the female terminal having an interlocking mechanical connection employing other interlocking mechanical features known to those skilled in the art may also be used successfully. The seam 34 shown in FIG. 3 is joined by a welded connection, in this example a spot weld. Other embodiments of the female terminal 10 having other welded connections known to those skilled in the art, such as a seam weld or tack weld may also be envisioned. Yet other embodiments of the female terminal may use a combination of an interlocking mechanical connection and a welded connection to join the seam. Alternative embodiments of the cover member may define a seam that is adjacent the connection portion rather than opposite the connection portion.

The cover member 20 is held in place on the base member 12 by tabs 36 protruding laterally from the connection portion 18 that are defined by opposed minor surfaces 38 of the connection portion 18. These tabs 36 are received in corresponding elongated apertures 40 defined by the side walls 28 of the cover member 20.

The female terminal 10 is configured so that the base member 12 provides the current carrying and the cover member 20 provides the clamping force to hold the male terminal 22 to the female terminal 10. Therefore, the materials used to construct the base member 12 and cover member 20 may be optimized for their specific purposes. The first material forming the base member 12 has a first thickness and the second material forming the cover member 20 has a second thickness. Because this embodiment of the female terminal 10 is configured to conduct large currents, e.g. in the range of 60 to 300 amperes, the first thickness of the material forming the base member 12 is greater than the second thickness, e.g. 0.6 to 1.5 mm vs. 0.2 to 0.5 mm, in order to provide sufficient current carrying capacity through the base member 12. In addition, the first material forming the base member 12 has a first conductivity and the second material forming the cover member 20 has a second conductivity. The first conductivity of the first material is greater than the second conductivity of the second material.

A major surface 42 of the connection portion 18 defines a contact ridge 44 that protrudes into the cavity 32 formed by the cover member 20. In the illustrated example, the major surface 42 of the connection portion 18 defines a plurality of separated contact ridges 44 each extending along the longitudinal axis X, i.e. along the insertion direction. Without subscribing to any particular theory of operation, these contact ridges 44 define the locations of electrical contact between the male and female terminals 10, 22.

Figure 4:
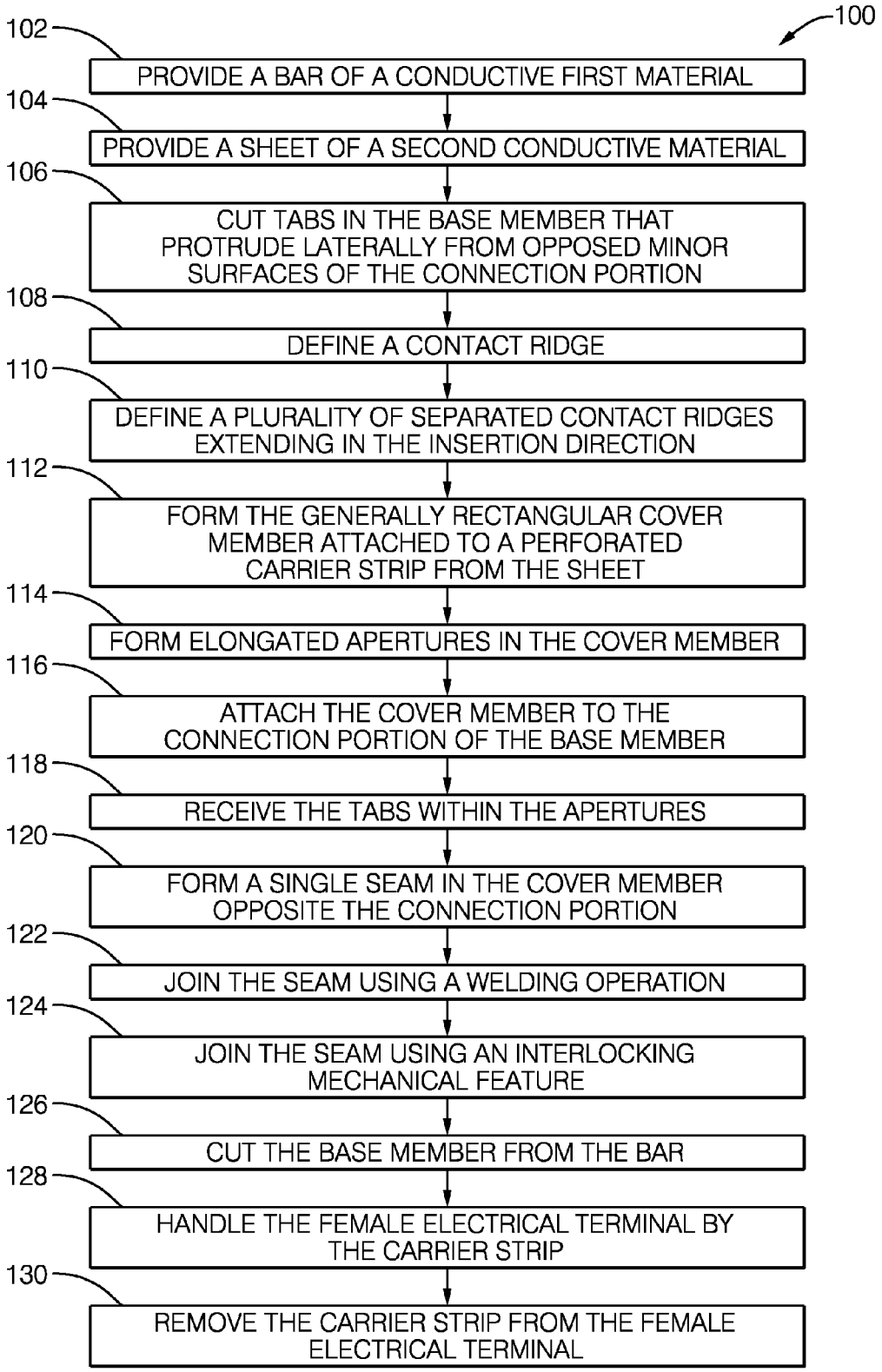
FIG. 4 is a flow chart of a method of manufacturing the female terminal assemblies of FIGS. 1 and 3 according to a third embodiment.
Figure 5:
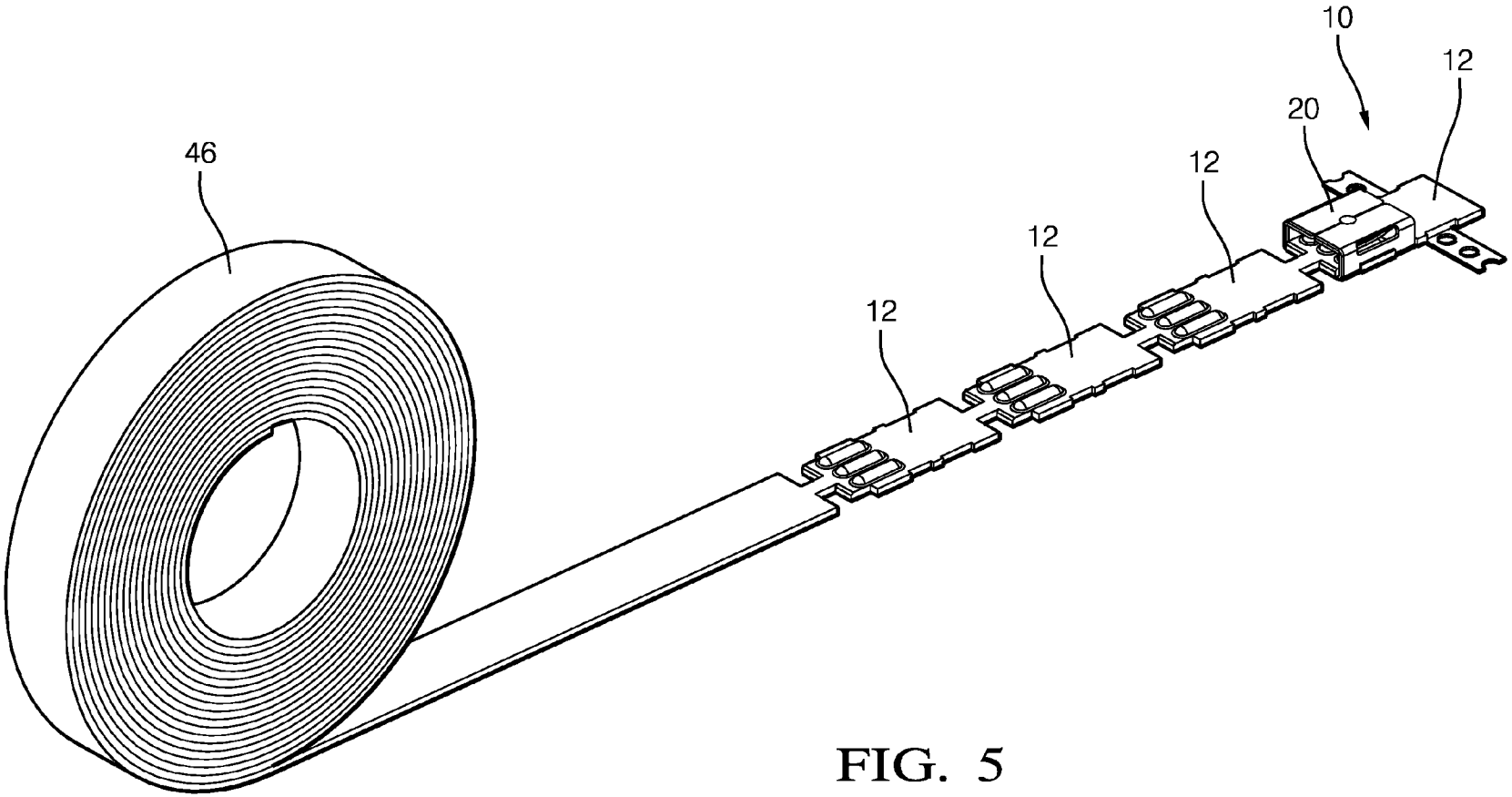
FIG. 5 is a perspective top view of a strip of material used to form the base member of the female terminal assembly of FIG. 1 according to the third embodiment.

FIG. 4 illustrates a non-limiting example of a method 100 of manufacturing a female terminal 10 having a generally planar base member 12 and a cover member 20. The base member 12 includes a connection portion 18 that is configured to electrically and mechanically contact with a corresponding male terminal 22. The base member 12 further includes an attachment portion 14 that is configured to be attached to a wire cable 16. The base member 12 extends along the longitudinal axis X, i.e. along an insertion direction corresponding to a direction in which the male terminal 22 is inserted into the female terminal 10. The cover member 20 longitudinally encircles the connection portion 18 along the longitudinal axis X and defines a biasing member 24 that depends from the cover member 20 and into a cavity 32 formed by the cover member 20. The biasing member 24 is configured to bias the male terminal 22 into electrical and frictional contact with the connection portion 18. The method 100 includes the following steps:

STEP 102, PROVIDE A BAR OF A CONDUCTIVE FIRST MATERIAL, includes providing a bar or strip of a conductive first material, such as a copper based alloy, having a generally rectangular cross section. As shown in FIG. 5, the bar for the first conductive material may be supplied from a roll 46 of the first material.

STEP 104, PROVIDE A SHEET OF A SECOND CONDUCTIVE MATERIAL, includes providing a sheet of a second conductive material, such as a stainless steel alloy. The first material has a first thickness and the second material has a second thickness. The first thickness may be greater than the second thickness. The first material has a first conductivity and the second material has a second conductivity. The first conductivity may be greater than the second conductivity.

STEP 106, CUT TABS IN THE BASE MEMBER THAT PROTRUDE LATERALLY FROM OPPOSED MINOR SURFACES OF THE CONNECTION PORTION, is an optional step that includes cutting a plurality of tabs 36 in the base member 12 that protrude laterally from opposed minor surfaces 38 of the connection portion 18 of the base member 12 as shown in FIG. 5. The tabs 36 are created by a material removal process, such as cutting, blanking, etching, or grinding.

STEP 108, DEFINE A CONTACT RIDGE, is an optional step that includes defining a raised contact ridge 44 in a major surface 42 of the connection portion 18 of the base member 12 as shown in FIG. 5. The contact ridge 44 is formed by an embossing operation. The contact ridge 44 is configured to protrude into the cavity 32 formed by the cover member 20.

STEP 110, DEFINE A PLURALITY OF SEPARATED CONTACT RIDGES EXTENDING ALONG THE LONGITUDINAL AXIS, is an optional step that includes defining a plurality of separated raised contact ridges 44 in a major surface 42 of the connection portion 18 of the base member 12 extending along the longitudinal axis X as shown in FIG. 5. This plurality of separated contact ridges 44 is formed by an embossing operation.

Figure 6:
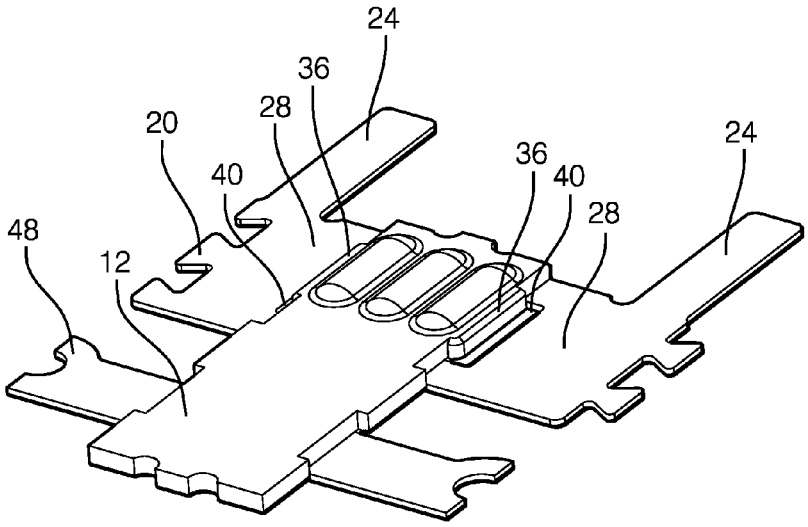
FIG. 6 is a perspective top view of a base member and a cover member of the female terminal assembly of FIG. 1 with the cover member in an unformed state according to the third embodiment.
Figure 7:
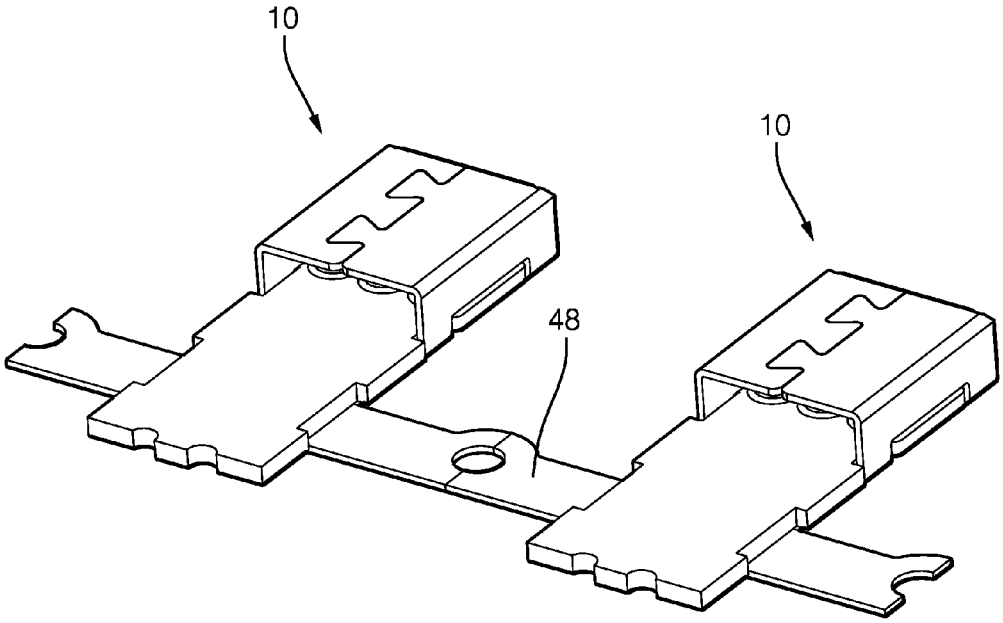
FIG. 7 is a perspective top view of a pair of female terminal assemblies of FIG. 1 attached by a carrier strip according to the third embodiment.

STEP 112, FORM THE GENERALLY RECTANGULAR COVER MEMBER ATTACHED TO A CARRIER STRIP FROM THE SHEET, includes stamping the cover member 20 from the sheet of a second conductive material provided in STEP 104. As shown in FIGS. 5 and 6, the cover member 20 includes a perforated carrier strip 48 that is attached to an adjacent cover member 20. The cover member 20 may also be stamped from a sheet of the second material supplied from a roll.

STEP 114, FORM ELONGATED APERTURES IN THE COVER MEMBER, is an optional step that includes forming elongated apertures 40 in the side walls 28 of the cover member 20. The apertures 40 are formed by a material removal process such as cutting or blanking.

STEP 116, ATTACH THE COVER MEMBER TO THE CONNECTION PORTION OF THE BASE MEMBER, includes attaching the cover member 20 to the connection portion 18 of the base member 12 by bending the cover member 20 so that it longitudinally encircles the connection portion 18 along the longitudinal axis X, thus forming the female terminal 14. The cover member 20 is folded to produce a top wall 26, two side walls 28, and a bottom wall 30 so as to form a rectangular shaped open box. The strips attached to the top wall 26 are bent to form an arcuate curve and folded so that they extend along the longitudinal axis X and depend from the top wall 26 of the cover member 20 and into a cavity 32 formed by the cover member 20, thus creating the biasing member 24.

STEP 118, RECEIVE THE TABS WITHIN THE APERTURES, is an optional step that includes receiving the tabs 36 defined by the base member 12 within the apertures 40 defined by the side walls 28 of the cover member 20 during STEP 116 ATTACH THE COVER MEMBER TO THE CONNECTION PORTION OF THE BASE MEMBER.

STEP 120, FORM A SINGLE SEAM IN THE COVER MEMBER OPPOSITE THE CONNECTION PORTION, is an optional step that includes forming a single seam 34 in the top wall 26 of the cover member 20 opposite the connection portion 18 and extending along the longitudinal axis X. Alternatively, the seam may be formed in the bottom wall adjacent the connection portion rather than opposite the connection portion.

STEP 122, JOIN THE SEAM USING A WELDING OPERATION, is an optional step that includes joining the seam 34 using a welding operation, such as spot welding, tack welding, or seam welding.

STEP 124, JOIN THE SEAM USING AN INTERLOCKING MECHANICAL FEATURE, is an optional step that includes joining the seam 34 using an interlocking mechanical feature, e.g. a dovetail feature defined by each edge of the seam 34 as shown in FIG. 1. Other interlocking mechanical features known to those skilled in the art may also be used successfully.

STEP 126, CUT THE BASE MEMBER FROM THE BAR, includes cutting or singulating the base member 12 from the bar of conductive first material, thus forming a female terminal 10. The base member 12 is cut from the bar using a cutting operation such as shearing or blanking. Immediately following this step, the female terminal 10 remains attached to the adjacent female terminal 10 via the carrier strip 48.

STEP 128, HANDLE THE FEMALE ELECTRICAL TERMINAL BY THE CARRIER STRIP, includes handling the female terminal 10 by the carrier strip 48. The female terminals 10 attached may be rolled onto a spool and then fed by the carrier strip 48 into a machine (not shown) to attach a wire cable 16 to the attachment portion 14 of the base member 12.

STEP 130, REMOVE THE CARRIER STRIP FROM THE FEMALE ELECTRICAL TERMINAL, includes removing the carrier strip 48 from the female terminal 10. This step may be performed after the wire cable 16 is attached to the female terminal 10. The carrier strip 48 is cut from the cover member 20 using a cutting operation such as shearing or blanking Accordingly a female terminal 10 and a method 100 of manufacturing such a female terminal 10 is provided. The female terminal 10 is capable of carrying currents up to 300 amperes. Terminals having thick current carrying members are difficult to form by bending operations. The base member 12 of the female terminal 10 may be formed using only cutting and embossing operation. The tooling used to produce the base member 12 can be simpler and the base member 12 required fewer manufacturing operation, thereby reducing tooling and production costs and providing a lower cost female terminal 10. In addition, the carrier strip 48 that remains attached to the cover member 20 providing the benefit of simplified handling of the female terminal 10. The thinner material of the cover member 20 also allows the female terminal 10 assembled to be rolled onto spools for material handling and is easier to cut than the material for the base member 12 once the wire cable 16 is attached to the female terminal 10.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A female electrical terminal, comprising:

a generally planar base member having a generally rectangular cross section and formed of a first conductive material, wherein the base member includes a connection portion configured to electrically and mechanically contact with a corresponding male electrical terminal and the base member further includes an attachment portion configured to be attached to a wire cable and wherein the base member extends longitudinally in an insertion direction corresponding to a direction in which said male electrical terminal is inserted into said female electrical terminal; and a cover member formed of a second conductive material, wherein the cover member longitudinally encircles the connection portion along a longitudinal axis and defines a biasing member depending from the cover member and into a cavity formed by the cover member, said biasing member configured to bias the male electrical terminal into electrical and frictional contact with the connection portion.

2. The female electrical terminal according to claim 1, wherein a major surface of the connection portion defines a contact ridge protruding into the cavity formed by the cover member.

3. The female electrical terminal according to claim 2, wherein the major surface of the connection portion defines a plurality of separated contact ridges extending in said insertion direction.

4. The female electrical terminal according to claim 1, wherein the cover member defines a single seam opposite the connection portion and extending along the longitudinal axis.

5. The female electrical terminal according to claim 4, wherein the seam is joined by a feature selected from the list comprising a welded connection and an interlocking mechanical connection.

6. The female electrical terminal according to claim 4, wherein the cover member includes, a top wall, two side walls, and a bottom wall proximate the connection portion so as to form a rectangular shaped open box.

7. The female electrical terminal according to claim 1, wherein opposed minor surfaces of the connection portion define tabs protruding laterally from the connection portion and the cover member defines elongated apertures configured to receive the tabs.

8. The female electrical terminal according to claim 1, wherein the first material has a first thickness and the second material has a second thickness and wherein the first thickness is greater than the second thickness.

9. The female electrical terminal according to claim 8, wherein the first material has a first conductivity and the second material has a second conductivity and wherein the first conductivity is greater than the second conductivity.

10. The female electrical terminal according to claim 9, wherein the first material is a copper based alloy and the second material is a stainless steel alloy.

11. A method of manufacturing a female electrical terminal having a generally planar base member and a cover member, wherein the base member comprises a connection portion configured to electrically and mechanically contact with a corresponding male electrical terminal and the base member further comprises an attachment portion configured to be attached to a wire cable, wherein the base member extends longitudinally in an insertion direction corresponding to a direction in which said male electrical terminal is inserted into said female electrical terminal and wherein the cover member longitudinally encircles the connection portion along a longitudinal axis and defines a biasing member depending from the cover member and into a cavity formed by the cover member, said biasing member configured to bias the male electrical terminal into electrical and frictional contact with the connection portion, said method comprising the steps of:

providing a bar of a conductive first material;

providing a sheet of a second conductive material;

cutting the base member from the bar;

forming a generally rectangular cover member attached to a perforated carrier strip from the sheet;

attaching the cover member to the connection portion of the base member by bending the cover member so that it longitudinally encircles the connection portion along the longitudinal axis, thus forming the female electrical terminal;

handling the female electrical terminal by the carrier strip; and removing the carrier strip from the female electrical terminal.

12. The method according to claim 11, further comprising the step of:

defining a contact ridge configured to protrude into the cavity formed by the cover member by embossing a major surface of the connection portion.

13. The method according to claim 12, further comprising the step of:

defining a plurality of separated contact ridges extending in said insertion direction by embossing the major surface of the connection portion.

14. The method according to claim 11, further comprising the step of:

forming a single seam in the cover member opposite the connection portion and extending longitudinally along the longitudinal axis.

15. The method according to claim 14, further comprising the step selected from the list consisting of:

joining the seam using a welding operation; and joining the seam using an interlocking mechanical feature.

16. The method according to claim 14, wherein the cover member is formed to include a top wall, two side walls, and a bottom wall proximate the connection portion so as to form a rectangular shaped open box.

17. The method according to claim 11, further comprising the step of:

cutting tabs in the base member that protrude laterally from opposed minor surfaces of the connection portion;

forming elongated apertures in the cover member; and receiving the tabs within the apertures during the step of attaching the cover member to the connection portion.

18. The method according to claim 11, wherein the first material has a first thickness and the second material has a second thickness and wherein the first thickness is greater than the second thickness.

19. The method according to claim 18, wherein the first material has a first conductivity and the second material has a second conductivity and wherein the first conductivity is greater than the second conductivity.

20. The method according to claim 19, wherein the first material is a copper based alloy and the second material is a stainless steel alloy.

* * * * *